US008066494B2

(12) United States Patent
Kamitani et al.

(10) Patent No.: US 8,066,494 B2
(45) Date of Patent: Nov. 29, 2011

(54) MICROPUMP

(75) Inventors: Gaku Kamitani, Kyoto (JP); Atsuhiko Hirata, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/238,535

(22) Filed: Sep. 26, 2008

(65) Prior Publication Data

US 2009/0010780 A1 Jan. 8, 2009

Related U.S. Application Data

(63) Continuation of application No. PCT/JP2007/052324, filed on Feb. 9, 2007.

(30) Foreign Application Priority Data

Mar. 29, 2006 (JP) ..... 2006-092329

(51) Int. Cl.
*F04B 35/04* (2006.01)

(52) U.S. Cl. ..... 417/413.2

(58) Field of Classification Search ..... 417/413.2, 417/412, 413.1, 481, 410.2; 977/733, 837
See application file for complete search history.

(56) References Cited

U.S. PATENT DOCUMENTS

| | | | | |
|---|---|---|---|---|
| 4,573,888 | A * | 3/1986 | Kitchin | 417/560 |
| 5,094,594 | A * | 3/1992 | Brennan | 417/413.2 |
| 5,171,132 | A * | 12/1992 | Miyazaki et al. | 417/413.1 |
| 5,718,567 | A | 2/1998 | Rapp et al. | |
| 6,116,866 | A * | 9/2000 | Tomita et al. | 417/413.2 |
| 6,390,791 | B1 | 5/2002 | Maillefer et al. | |
| 6,682,318 | B2 * | 1/2004 | Takeuchi et al. | 417/322 |
| 7,284,966 | B2 * | 10/2007 | Xu et al. | 417/395 |
| 2005/0074340 | A1 | 4/2005 | Xu et al. | |

FOREIGN PATENT DOCUMENTS

| | | | |
|---|---|---|---|
| DE | 43 32 720 | A1 | 3/1995 |
| DE | 102 44 106 | A | 3/2004 |
| DE | 698 13 569 | T2 | 4/2004 |
| JP | 61-36787 | | 1/1984 |
| JP | 3-8680 | U | 1/1991 |
| JP | 03-225086 | | 10/1991 |
| JP | 11-173232 | | 6/1999 |
| JP | 2003-214349 | | 7/2003 |
| JP | 2005-283331 | | 10/2005 |
| JP | 2005-337068 | | 12/2005 |
| JP | 3747271 | B2 | 2/2006 |
| WO | WO-92/01160 | | 1/1992 |
| WO | WO-95/20105 | | 7/1995 |

OTHER PUBLICATIONS

PCT/JP2007/052325 International Search Report dated Apr. 17, 2007. PCT/JP2007/052325 Written Opinion dated Apr. 17, 2007.
Official Communication issued in corresponding Chinese Patent Application No. 2007800121470, issued on Feb. 12, 2010.
Official Communication issued in corresponding Japanese Patent Application No. 2008-507390, mailed on Mar. 22, 2011.

* cited by examiner

*Primary Examiner* — Devon C Kramer
*Assistant Examiner* — Bryan Lettman
(74) *Attorney, Agent, or Firm* — Keating & Bennett, LLP

(57) ABSTRACT

A micropump having a diaphragm portion, a valve portion of an intake-side check valve, and a valve portion of a discharge-side check valve formed in a single elastic-member sheet. A piezoelectric actuator is attached onto a back surface of the diaphragm portion. The elastic-member sheet is sandwiched between a first case member and a second case member, the elastic-member sheet providing sealing between both case members. A vibration chamber is defined between the elastic-member sheet and the first case member, the vibration chamber housing the piezoelectric actuator. A pump chamber is defined between the elastic-member sheet and the second case member.

6 Claims, 7 Drawing Sheets

MICROPUMP

CROSS REFERENCE TO RELATED APPLICATIONS

The present application is a continuation of International Application No. PCT/JP2007/052324, filed Feb. 9, 2007, which claims priority to Japanese Patent Application No. JP2006-092329, filed Mar. 29, 2006, the entire contents of each of these applications being incorporated herein by reference in their entirety.

FIELD OF THE INVENTION

The present invention relates to micropumps, and more particularly to a micropump using a piezoelectric actuator which undergoes bending deformation.

BACKGROUND OF THE INVENTION

Micropumps are used as cooling pumps for small electronic devices like notebook computers, or fuel transportation pumps for fuel cells. A micropump is a pump using a piezoelectric actuator which undergoes bending deformation in a bending mode by application of a voltage. The micropump has a relatively simple structure, with a reduced thickness as compared with the thickness of a pump using a motor as a drive source, and with low power consumption.

Patent Document 1 discloses a micropump in which a pump chamber is formed in a pump body, a piezoelectric actuator is attached onto a back surface (upper surface) of a diaphragm defining a top wall of the pump chamber, and an intake-side check valve and a discharge-side check valve are arranged directly below the pump chamber. This micropump has a structure, in which the pump chamber is located directly above the check valves, and the diaphragm and the piezoelectric actuator are arranged on the pump chamber. Hence, the thickness of the micropump is increased, thereby being disadvantageous in the reduction in thickness.

Patent Document 2 discloses a micropump in which a diaphragm defining a pump chamber, an intake-side check valve, and a discharge-side check valve are arranged in a plane. This micropump can be reduced in thickness as compared with the thickness of the micropump disclosed in Patent Document 1. However, since the diaphragm, and valve portions of the intake-side check valve and discharge-side check valve are formed of separate members. Hence, the number of components is increased, and the manufacturing cost is increased. In particular, when the check valves have umbrella structures having shaft portions and hood portions, the structures are complicated, resulting in the manufacturing cost being further increased.

Patent Document 3 discloses a diaphragm pump in which a valve portion of a check valve and a diaphragm portion are integrally formed. With this diaphragm pump, a coupling rod mounted to a motor via an eccentric shaft is coupled to a boss protruding from a back surface of the diaphragm portion. Also, ribs are provided between the valve portion and the diaphragm portion and at a peripheral edge, so as to prevent air from leaking. The valve portion and the diaphragm portion are formed of a single elastic member; however, it is necessary to mold the ribs and the boss in three dimensions, resulting in the cost being increased, and the thickness being increased. Further, since the drive source of the diaphragm portion is the motor, the thickness of the pump is large, and power consumption is high. Thus, the pump cannot be applied to a small electronic device.

Patent Document 1: Japanese Unexamined Patent Application Publication No. 2003-214349

Patent Document 2: Japanese Unexamined Patent Application Publication No. 2005-337068

Patent Document 3: Japanese Examined Utility Model Registration Application Publication No. 61-36787

SUMMARY OF THE INVENTION

Accordingly, an object of a preferred embodiment of the present invention is to provide a thin micropump having a simple structure with a reduced number of components.

Another object is to provide a micropump capable of being inexpensively manufactured.

To attain the above-described objects, the present invention provides a micropump that transmits bending displacement of a piezoelectric actuator to a pump chamber via a diaphragm portion to change a volume of the pump chamber, and alternately opens and closes an intake-side check valve and a discharge-side check valve to transport fluid. The micropump includes an elastic-member sheet, a first case member, and a second case member having constant thicknesses. In the micropump, the diaphragm portion, a valve portion of the intake-side check valve, and a valve portion of the discharge-side check valve are integrally formed at the elastic-member sheet. The piezoelectric actuator is attached onto a back surface of the diaphragm portion. The elastic-member sheet is sandwiched between the first and second case members, the elastic-member sheet providing sealing between the first and second case members. A vibration chamber is defined between the elastic-member sheet and the first case member, the vibration chamber housing the piezoelectric actuator. A pump chamber is defined between the elastic-member sheet and the second case member.

With the micropump of the present invention, the diaphragm portion, the valve portion of the intake-side check valve, and the valve portion of the discharge-side check valve are integrally formed in the elastic-member sheet having the constant thickness. Also, the elastic-member sheet is sandwiched between the first and second case members. Accordingly, the diaphragm portion, the intake-side check valve, and the discharge-side check valve can be arranged in a plane. Thus, the thickness is reduced, the number of components is reduced, and the structure is simplified. The piezoelectric actuator is attached onto the back surface of the diaphragm portion, and the diaphragm portion is deformed by the bending deformation of the actuator. Hence, a flow of the fluid passing through the intake-side check valve and flowing into the pump chamber when the volume of the pump chamber is increased by the deformation of the diaphragm portion, and a flow of the fluid passing through the discharge-side check valve and flowing out from the pump chamber when the volume of the pump chamber is decreased, are generated, and thus the fluid can be efficiently transported. As described above, since the single elastic-member sheet has the function of a diaphragm and the functions of valve bodies of the intake-side check valve and the discharge-side check valve, the reduction in the number of components and the simplification of the valve attachment can be promoted, resulting in reduction in size, thickness, and cost of the pump. Further, since the elastic-member sheet also serves as a liquid-leak-prevention seal for providing sealing between the inside and outside of the pump chamber and between the inside and outside of the valve chamber, an additional seal member such as an O-ring is not necessary, and three-dimensional processing such as formation of ribs is not necessary. Thus, high reliability can be achieved by the simple configuration with the reduced number of components.

According to a preferred embodiment, the intake-side check valve and the discharge-side check valve may be provided at opposite positions with the pump chamber interposed therebetween, and the fluid entering from the intake-side check valve may be transported to the discharge-side check valve via the pump chamber in a forward direction. Since the fluid passing through the intake-side check valve and flowing into the pump chamber, and the fluid passing through the discharge-side check valve and flowing out from the pump chamber by the driving of the diaphragm flow in the forward direction, that is, since the fluid do not flow in a reverse direction, a loss disturbing the flow of the fluid is reduced. The intake-side check valve, the pump chamber, and the discharge-side check valve do not have to be arranged in a straight line. However, a flow-direction variation angle may be preferably within 90°. With this arrangement, a pumping rate is likely to be increased even when a small pump with a small-power piezoelectric actuator is used. Further, when the pump chamber in an empty state draws in the fluid, the air in the pump chamber is likely to be discharged from the discharge-side check valve by being pushed by the intake fluid. Thus, air bubbles hardly remain in the pump chamber. Accordingly, a pumping efficiency can be prevented from being deteriorated.

According to a preferred embodiment, the piezoelectric actuator may be formed into a rectangular shape, and the intake-side check valve and the discharge-side check valve may be respectively arranged at positions near short sides of the piezoelectric actuator. The shape of the piezoelectric actuator may be a circular shape or a rectangular shape. When a rectangular piezoelectric actuator undergoes bending displacement in a mode in which both end portions in a longitudinal direction (two short sides) of the piezoelectric actuator serve as supporting points, a larger volume displacement can be obtained, as compared with a case in which a circular piezoelectric actuator undergoes bending displacement in a mode in which an outer peripheral portion of the piezoelectric actuator serves as a supporting point. Hence, when the rectangular piezoelectric actuator is used as a diaphragm-drive actuator, the pumping efficiency can be enhanced. Also, when the rectangular piezoelectric actuator is used, the check valves are not located near the maximum displacement point of the actuator as long as the intake-side check valve and the discharge-side check valve are respectively arranged at the positions near the short sides of the actuator. Thus, unwanted fluttering of the valves due to the rapid flow of the fluid can be prevented.

According to a preferred embodiment, the first case member may be a plate member including a vibration-chamber recess, an intake-passage recess isolated from the vibration-chamber recess, and a discharge-space recess isolated from the vibration-chamber recess. The second case member may be a plate member including a pump-chamber recess, an intake-space recess communicating with the pump-chamber recess and facing the intake-passage recess, and a discharge-passage recess communicating with the pump-chamber recess and facing the discharge-space recess. The valve portion of the intake-side check valve configured to close the intake-passage recess, and the valve portion of the discharge-side check valve configured to close the discharge-passage recess may be formed into tongue-like shapes. The first and second case members having the recesses can be easily manufactured by a known method such as injection molding. The micropump is formed of the three components of the first case member, the second case member, and the elastic-member sheet, and the micropump can be constructed by layering the first and second case members with the elastic-member sheet interposed therebetween. Accordingly, the thin, easily manufactured micropump with the reduced number of components can be provided.

According to preferred embodiment, the first case member may include a bottom plate which is a flat plate, and a first intermediate layer in which a vibration-chamber hole, an intake-passage hole isolated from the vibration-chamber hole, and a discharge-space hole isolated from the vibration-chamber hole are formed in a flat plate, the bottom plate and the first intermediate layer being layered. The second case member may include a top plate which is a flat plate, and a second intermediate layer in which a pump-chamber hole, an intake-space hole facing the intake-passage hole, and a discharge-passage hole facing the discharge-space hole are continuously formed in a flat plate, the top plate and the second intermediate layer being layered. The valve portion of the intake-side check valve configured to close the intake-passage hole, and the valve portion of the discharge-side check valve configured to close the discharge-passage hole may be formed into tongue-like shapes. With this embodiment, the bottom plate and the first intermediate layer defining the first case member; the elastic-member sheet; and the top plate and the second intermediate layer defining the second case member are formed of two-dimensionally processed plate members. The micropump can be constructed merely by layering these plate members, and hence, the micropump can be easily manufactured. Accordingly, the thin, highly reliable micropump can be provided. The tongue-shaped valve portions of the elastic-member sheet, the holes of the first intermediate layer, and the holes of the second intermediate layer can be easily formed by punching or laser processing the flat plates. Thus, a mold is not necessary, processing can be inexpensively performed, and warpage or distortion does not occur. The bottom plate and the first intermediate layer defining the first case member, and the top plate and the second intermediate layer defining the second case member may be formed of a resin plate, a metal plate, or a composite material such as a glass epoxy board.

According to a preferable embodiment, a length of a communication passage which connects the pump chamber with an intake space, and a length of a communication passage which connects the pump chamber with a discharge passage may be respectively larger than flow-passage widths thereof. The elastic-member sheet is sandwiched between the upper and lower case members, and hence, the elastic-member sheet provides a sealing effect. However, portions of the elastic-member sheet corresponding to the communication passages which connect the pump chamber with the intake-side and discharge-side check valves are not sandwiched by the upper and lower case members. That is, a wall surface is provided only at one side of the elastic-member sheet. Thus, liquid has to be prevented from leaking by a bonding force of the elastic-member sheet and the case member at one side. However, liquid possibly leaks to the vibration chamber from a portion of the elastic-member sheet processed by punching or cutting for formation of the valve portions. The leakage may cause a pumping failure. Owing to this, the lengths of the communication passages which connect the pump chamber with the intake-side and discharge-side check valves are respectively set larger than the flow-passage widths thereof. Accordingly, the elastic-member sheet can be sandwiched between the first and second case members at middle portions of the communication passages, and hence, a sufficient sealing effect can be provided even when a bonding state exhibits a low intensity.

As a specific method of increasing the length of the communication passage to be longer than the passage width, the communication passage which connects the pump chamber with the intake space, and the communication passage which connects the pump chamber with the discharge passage may have crank-like shapes.

Although the piezoelectric actuator may have a unimorph structure in which a piezoelectric substance is layered on a metal plate, use of a bimorph structure in which a plurality of piezoelectric substances are layered is preferable because a larger volume displacement can be provided than that of the unimorph structure. The elastic-member sheet may be any soft elastic sheet formed of, for example, butyl rubber.

As described above, with the present invention, since the diaphragm portion, the intake-side check valve, and the discharge-side check valve are formed in the single elastic-member sheet, the diaphragm portion, the intake-side check valve, and the discharge-side check valve can be arranged in a plane, thereby achieving a reduced thickness. Also, the inexpensive micropump having the simple structure with the reduced number of components can be provided.

REFERENCE NUMERALS

Figure 1:
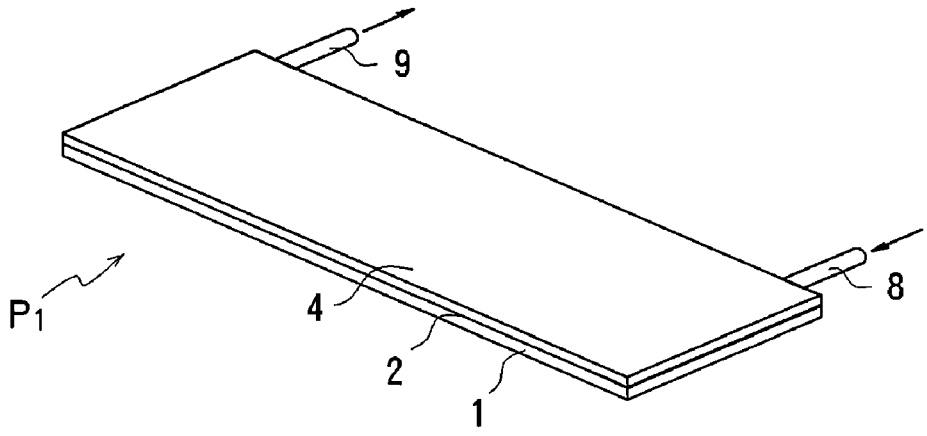
FIG. 1 is a perspective view showing a micropump according to a first embodiment of the present invention.
Figure 2:
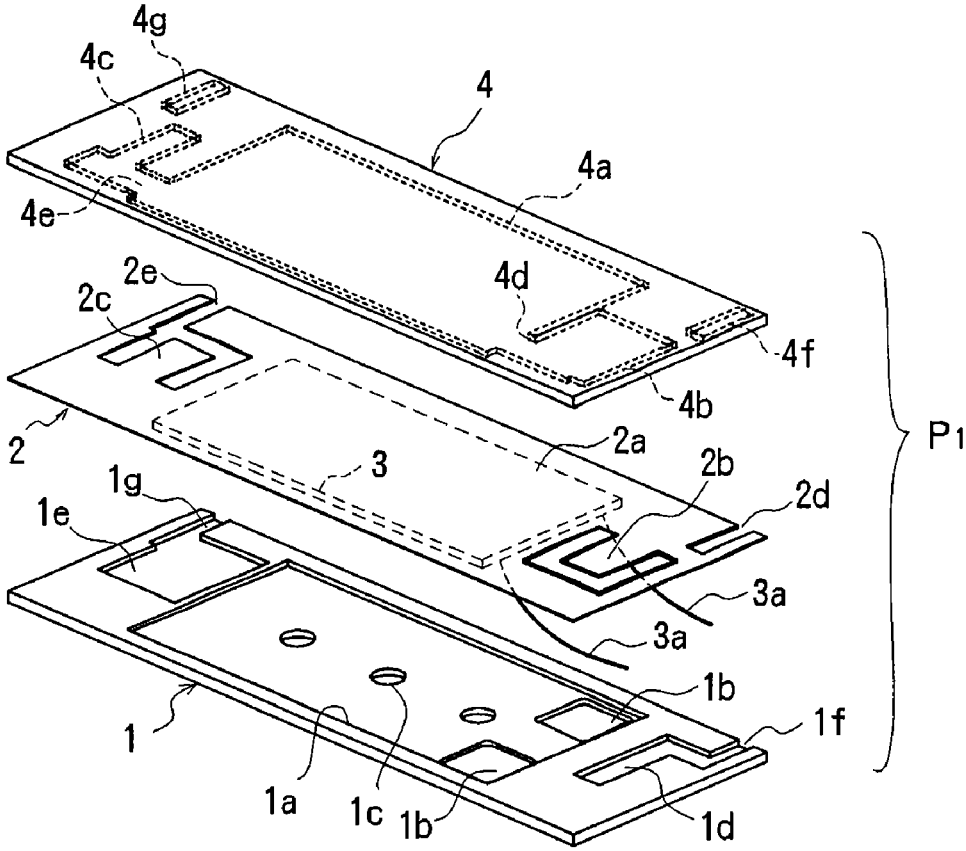
FIG. 2 is an exploded perspective view showing the micropump in FIG. 1.
Figure 3:
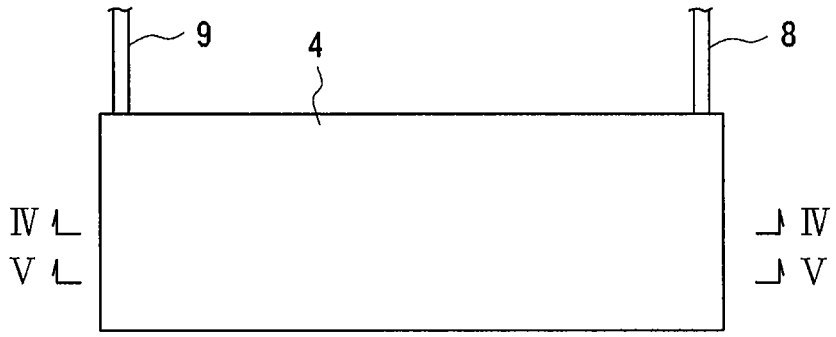
FIG. 3 is a plan view showing the micropump in FIG. 1.
Figure 4:
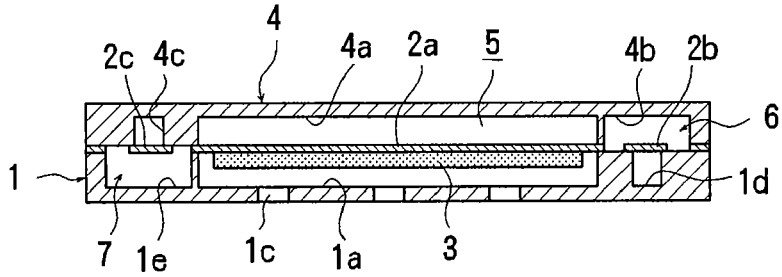
FIG. 4 is a cross section taken along line IV-IV in FIG. 3.
Figure 5:
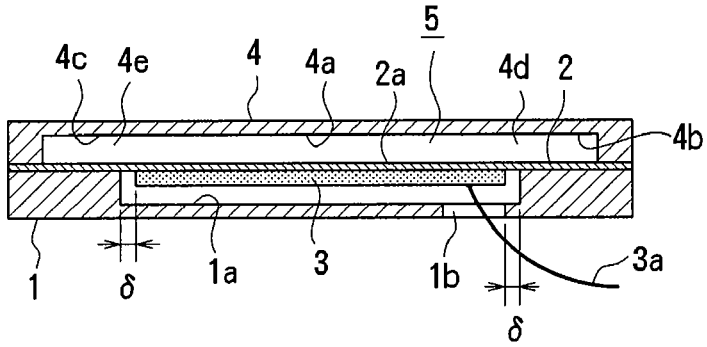
FIG. 5 is a cross section taken along line V-V in FIG. 3.

P1, P2 micropump
1 lower case (first case member)
1*a* vibration chamber (recess)
2 elastic-member sheet
2*a* diaphragm portion
2*b*, 2*c* valve portion
3 piezoelectric actuator
4 upper case (second case member)
5 pump chamber
6 intake-side check valve
7 discharge-side check valve
10 bottom plate
11 first intermediate layer
12 elastic-member sheet
13 second intermediate layer
14 top plate

DETAILED DESCRIPTION OF THE INVENTION

Hereinafter, best modes of the present invention are described below with reference to embodiments.

First Embodiment

FIGS. 1 to 6 illustrate a micropump according to a first embodiment of the present invention. A micropump P1 of this embodiment includes a three-layer structure of a lower case 1, an elastic-member sheet 2, and an upper case 4. These components are mutually layered and bonded.

The lower case 1 is formed of, for example, a glass epoxy board or a resin board, into a rectangular plate shape. A rectangular recess 1*a* serving as a vibration chamber is formed at a center portion of the lower case 1. Two ports 1*b* and a plurality of air-bleeding holes 1*c* are formed at a bottom surface of the recess 1*a*. Leads 3*a* of a piezoelectric actuator 3 (described later) are led from the ports 1*b*. The air-bleeding holes 1*c* cause the vibration chamber to be exposed to the air. If the ports 1*b* can also serve as air-bleeding holes, the air-bleeding holes 1*c* may be omitted. The depth of the recess 1*a* is determined to be larger than the sum of the thickness of the piezoelectric actuator 3 and a maximum displacement distance. An intake-passage recess 1*d* and a discharge-space recess 1*e* are formed respectively at positions near short sides of the vibration-chamber recess 1*a*. The intake-passage recess 1*d* and the discharge-space recess 1*e* are provided separately from the vibration-chamber recess 1*a*, and communicate with the outside respectively via an intake port if and a discharge port 1*g*.

The elastic-member sheet 2 is a sheet formed of a soft elastic material such as rubber, elastomer, or soft resin, and having a constant thickness. The elastic-member sheet 2 has a shape equivalent to that of the lower case 1. A diaphragm portion 2*a* is provided at a center portion of the elastic-member sheet 2. A valve portion 2*b* of an intake-side check valve and a valve portion 2*c* of a discharge-side check valve are formed integrally with the elastic-member sheet 2 on both sides of the diaphragm portion 2*a*. The valve portions 2*b* and 2*c* are formed into tongue-like shapes by punching or cutting. The piezoelectric actuator 3 is face-bonded onto a back surface (lower surface) of the diaphragm portion 2*a*. Hence, a back surface of the elastic-member sheet 2 not occupied by the diaphragm portion 2*a* and the valve portions 2*b* and 2*c* is bonded onto an upper surface of the lower case 1. When the elastic-member sheet 2 is bonded to the lower case 1, the valve portions 2*b* and 2*c* respectively correspond to the intake-passage recess 1*d* and the discharge-space recess 1*e*. Also, cut portions 2*d* and 2*e* are formed at portions of the elastic-member sheet 2, the portions respectively corresponding to the intake port if and the discharge port 1*g* of the lower case 1.

The piezoelectric actuator 3 has a rectangular shape, and is housed in the recess 1*a*. The outside dimension of the piezoelectric actuator 3 is smaller than the inside dimension of the recess 1*a*. When the piezoelectric actuator 3 is housed in the recess 1*a*, predetermined gaps δ (see FIG. 5) are provided between four sides of the piezoelectric actuator 3 and inner peripheral edges of the recess 1*a*. The gaps δ correspond to margins of the diaphragm portion 2*a*. The diaphragm portion 2*a* can be sufficiently expanded at the margins when the piezoelectric actuator 3 undergoes bending displacement. The piezoelectric actuator 3 of this embodiment is a known bimorph-type ceramic piezoelectric element. The piezoelectric actuator 3 has electrodes at a lower surface thereof. The two leads 3*a* are connected to the electrodes. By application of an alternating signal (rectangular wave signal or alternating signal) to the leads 3*a*, the piezoelectric actuator 3 may undergo bending vibration in a bending mode in which both end portions in a longitudinal direction (two short sides) of the piezoelectric actuator 3 serve as supporting points, and a center portion in the longitudinal direction thereof serves as a maximum displacement point. Alternatively, the piezoelectric actuator 3 may be a unimorph-type piezoelectric actuator.

The upper case 4 is formed of a similar material to that of the lower case 1, into a rectangular plate shape. A rectangular pump-chamber recess 4*a*, an intake-space recess 4*b*, and a discharge-passage recess 4*c* are continuously formed at a lower surface of the upper case 4. The pump-chamber recess 4*a* communicates with the intake-space recess 4*b* via a communication passage 4*d*. The pump-chamber recess 4*a* communicates with the discharge-passage recess 4*c* via a communication passage 4*e*. When the lower surface of the upper case 4 is bonded onto the upper surface of the elastic-member sheet 2, the pump-chamber recess 4*a* corresponds to the diaphragm portion 2*a*, the intake-space recess 4*b* corresponds to the valve portion 2*b* and the intake-passage recess 1*d*, and the discharge-passage recess 4*c* corresponds to the valve portion 2*c* and the discharge-space recess 1*e*. Also, grooves 4*f* and 4*g* are separately formed at portions of the upper case 4, the portions respectively corresponding to the intake port if and the discharge port 1*g* of the lower case 1.

As described above, the lower case 1, the elastic-member sheet 2, and the upper case 4 are layered and bonded, and thus, the micropump is completed. A pump chamber 5 is defined between the recess 4*a* and the diaphragm portion 2*a*. An intake-side check valve 6 is defined by the valve portion 2*b*, the intake-passage recess 1*d*, and the intake-space recess 4*b*. A discharge-side check valve 7 is defined by the valve portion 2*c*, the discharge-space recess 1*e*, and the discharge-passage recess 4*c* (see FIG. 4). A liquid-supply tube 8 and a liquid-discharge tube 9 (see FIG. 1) are respectively connected to the intake port 1*f* and the discharge port 1*g*.

Figure 6A:
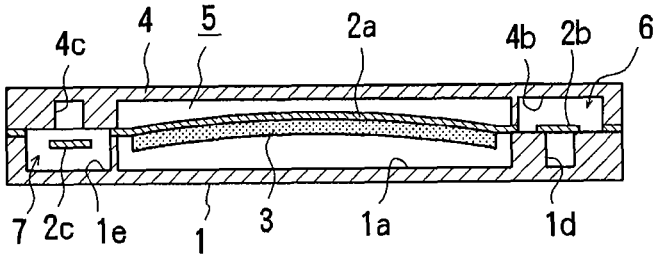
FIGS. 6(*a*) and 6(*b*) illustrate cross sections schematically showing an operation of the micropump in FIG. 1, FIG. 6(*a*) showing an upwardly bulging state of a piezoelectric actuator, and FIG. 6(*b*) showing a downwardly bulging state thereof.
Figure 6B:
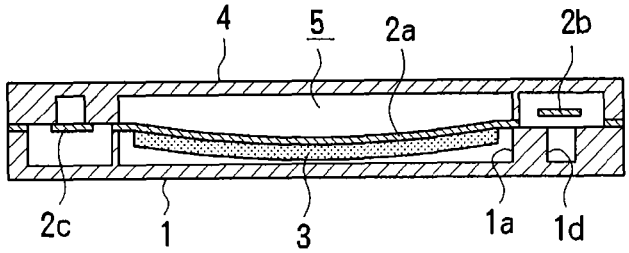
Figure 7:
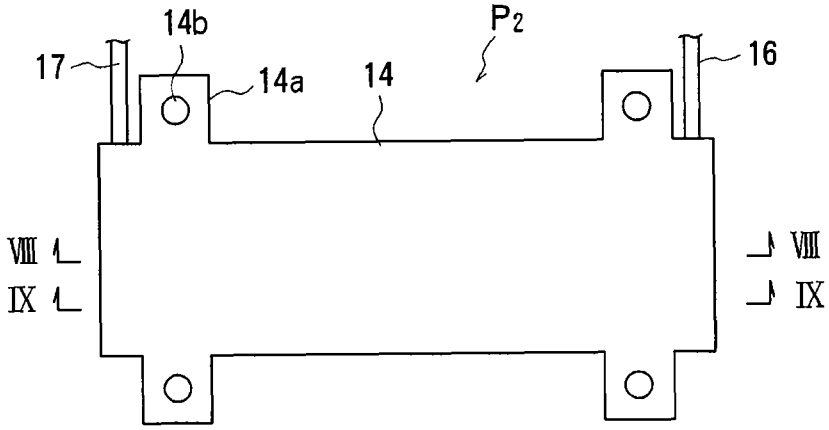
FIG. 7 is a plan view showing a micropump according to a second embodiment of the present invention.
Figure 8:
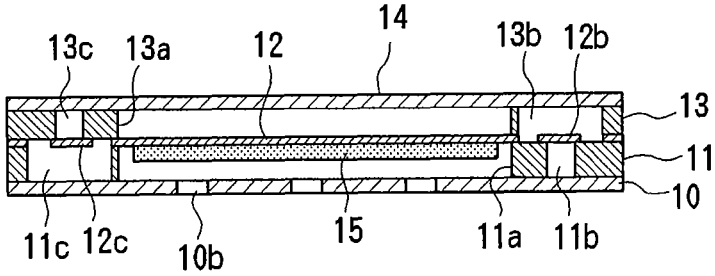
FIG. 8 is a cross section taken along line VIII-VIII in FIG. 7.
Figure 9:
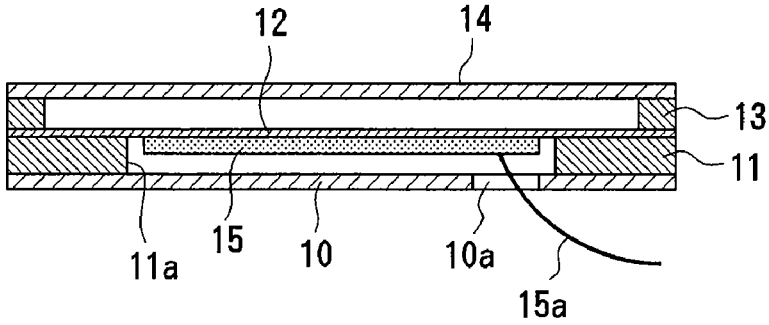
FIG. 9 is a cross section taken along line XI-XI in FIG. 7.
Figure 10:
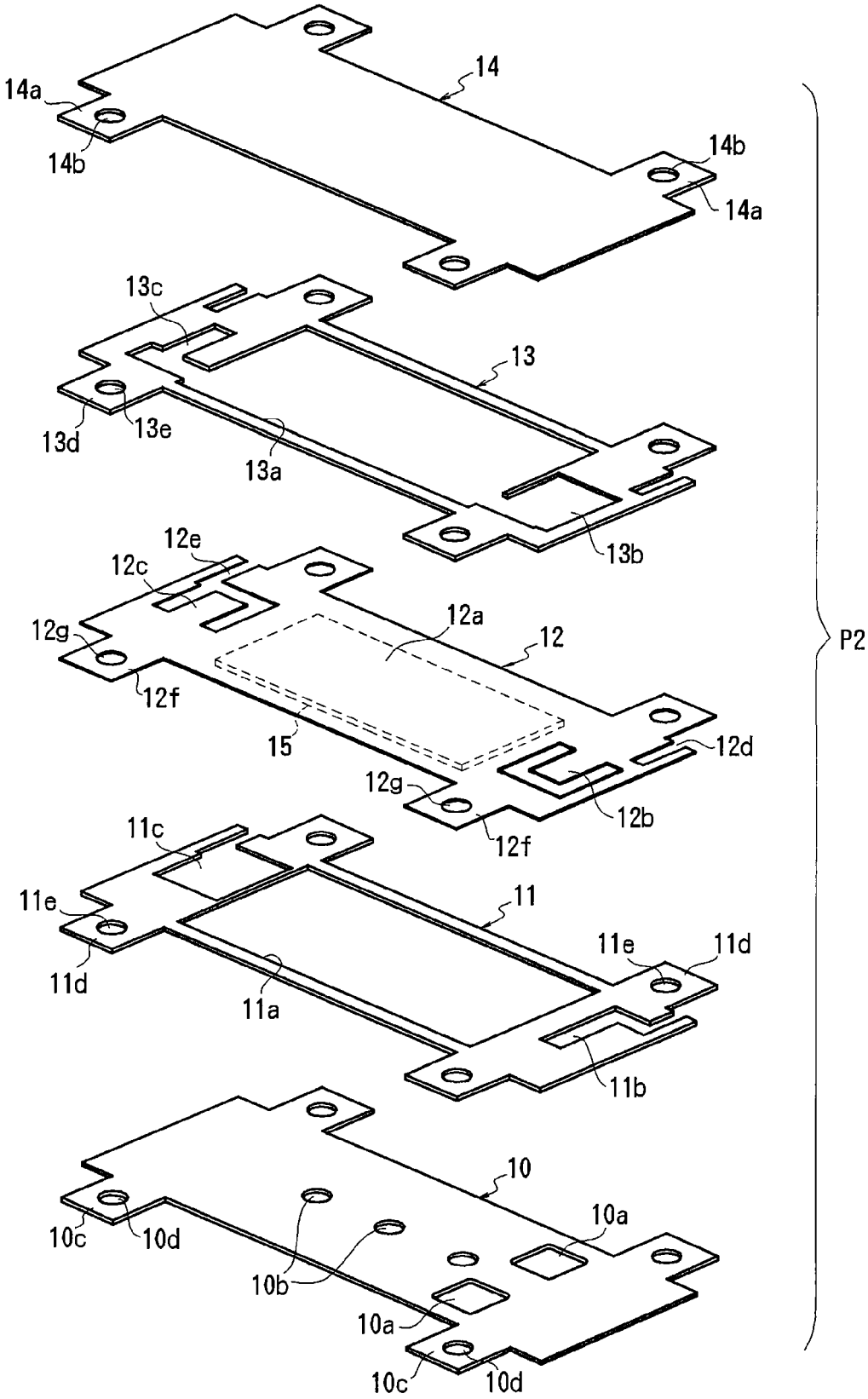
FIG. 10 is an exploded perspective view of the micropump in FIG. 7.

When an alternating voltage (rectangular wave voltage or alternating voltage) is applied to the piezoelectric actuator 3, the piezoelectric actuator 3 undergoes bending deformation while both end portions in the longitudinal direction of the piezoelectric actuator 3 serve as supporting points and a center portion in the longitudinal direction thereof serves as a maximum displacement point, and then the diaphragm portion 2*a* is deformed by the bending deformation of the piezoelectric actuator 3. Accordingly, the volume of the pump chamber 5 can be changed. FIG. 6(*a*) illustrates an upwardly bulging state of the actuator 3, and FIG. 6(*b*) illustrates a downwardly bulging state of the actuator 3. The intake-side valve portion 2*b* closes the intake-passage recess 1*d* when the volume of the pump chamber 5 is decreased, and is open when the volume of the pump chamber 5 is increased, so as to guide fluid into the pump chamber 5. The discharge-side valve portion 2*c* closes the discharge-passage recess 4*c* when the volume of the pump chamber 5 is increased, and is open when the volume of the pump chamber 5 is decreased, so as to discharge the fluid from the pump chamber 5. As described above, by driving the piezoelectric actuator 3, the fluid can be efficiently transported via the intake-side check valve 6, the pump chamber 5, and then the discharge-side check valve 7.

The intake-side check valve 6 and the discharge-side check valve 7 are provided at opposite positions with the pump chamber 5 interposed therebetween. The liquid entering from the intake-side check valve 6 can be transported to the discharge-side check valve 7 via the pump chamber 5 in a forward direction, and the liquid does not flow in a reverse direction in the pump chamber 5. Thus, fluid loss is small. Even when gas enters the pump chamber 5, the gas is pushed out by the flow of the liquid via the intake-side check valve 6, the pump chamber 5, and then the discharge-side check valve 7 in the forward direction. Thus, the gas does not remain in the pump chamber 5. In this embodiment, since the intake-side check valve 6 and the discharge-side check valve 7 are respectively arranged at the positions near the opposite short sides of the piezoelectric actuator 3, the check valves are located at positions farthest from the maximum displacement point of the actuator 3. Hence, fluttering of the valves due to the rapid flow of the fluid can be prevented.

Second Embodiment

FIGS. 7 to 10 illustrate a micropump according to a second embodiment of the present invention. A micropump P2 of this embodiment includes a five-layer structure of a bottom plate 10, a first intermediate layer 11, an elastic-member sheet 12, a second intermediate layer 13, and a top plate 14. These components are mutually layered and bonded.

The bottom plate 10 is a flat plate formed of, for example, a glass epoxy board, a resin plate, or a metal plate. Two ports 10*a* and a plurality of air-bleeding holes 10*b* are formed at the bottom plate 10. Leads 15*a* of a piezoelectric actuator 15 are led from the ports 10*a*. The air-bleeding holes 10*b* cause the vibration chamber to be exposed to the air. The air-bleeding holes 10*b* may be provided only if necessary. Two pairs of attachment pieces 10*c* having screw insertion holes 10*d* are integrally formed at both side portions of the bottom plate 10.

The first intermediate layer 11 is a flat plate formed of a similar material to that of the bottom plate 10, into a similar external shape to that of the bottom plate 10. A rectangular vibration-chamber hole 11*a* for defining the vibration chamber is formed at a center portion of the first intermediate layer 11. An intake-passage hole 11*b* and a discharge-space hole 11*c* are formed in an isolated manner from the vibration-chamber hole 11*a*. Two pairs of attachment pieces 11*d* having screw insertion holes 11*e* are integrally formed at both side portions of the first intermediate layer 11 at positions corresponding to the positions of the attachment pieces 10*c* of the bottom plate 10.

The elastic-member sheet 12 is similar to the elastic-member sheet 2 of the first embodiment except that the elastic-member sheet 12 has attachment pieces 12*f* at four positions at both side portions thereof. The elastic-member sheet 12 has a diaphragm portion 12*a*, an intake-side valve portion 12*b*, a discharge-side valve portion 12*c*, and cut portions 12*d* and 12*e*. The attachment pieces 12*f* have screw insertion holes 12*g*. The piezoelectric actuator 15, which is similar to that of the first embodiment, is attached onto a back surface (lower surface) of the diaphragm portion 12*a*.

The second intermediate layer 13 is a flat plate formed of a similar material to that of the bottom plate 10, into a similar external shape to that of the bottom plate 10. A rectangular pump-chamber hole 13*a* is formed at a center portion of the second intermediate layer 13. An intake-space hole 13*b* and a discharge-passage hole 13*c* are formed at both end portions in a longitudinal direction of the second intermediate layer 13 so as to communicate with the pump-chamber hole 13*a*. Two pairs of attachment pieces 13*d* having screw insertion holes 13*e* are integrally formed at both side portions of the second intermediate layer 13.

The top plate 14 is a flat plate having a similar external shape to that of the bottom plate 10. Two pairs of attachment pieces 14*a* having screw insertion holes 14*b* are integrally formed at both side portions of the top plate 14. By bonding the top plate 14 onto an upper surface of the second intermediate layer 13, a pump chamber, an intake passage, and a discharge passage are defined between the top plate 14 and the elastic-member sheet 12.

The above-described bottom plate 10, first intermediate layer 11, elastic-member sheet 12, second intermediate layer 13, and top plate 14 are layered and bonded, thereby defining the micropump P2. Tubes 16 and 17 are respectively connected to the intake passage and the discharge passage. Then, screws are inserted into the screw insertion holes of the layered attachment pieces, and accordingly, the micropump P2 can be attached to a device body (not shown). Alternatively, rivets or the like may be inserted into the screw insertion holes of the attachment pieces, instead of the screws. Still alternatively, the attachment pieces may be omitted.

As described above, all the components defining the micropump P2 are two-dimensionally-processed flat plates having constant thicknesses. By layering and bonding these components, the micropump can be defined without necessity of a mold. Accordingly, the micropump P2 can be easily and inexpensively manufactured with a reduced thickness. An operation of the above-described micropump P2 is similar to that of the micropump P1 of the first embodiment. Hence, the redundant description is omitted.

Third Embodiment

Figure 11A:
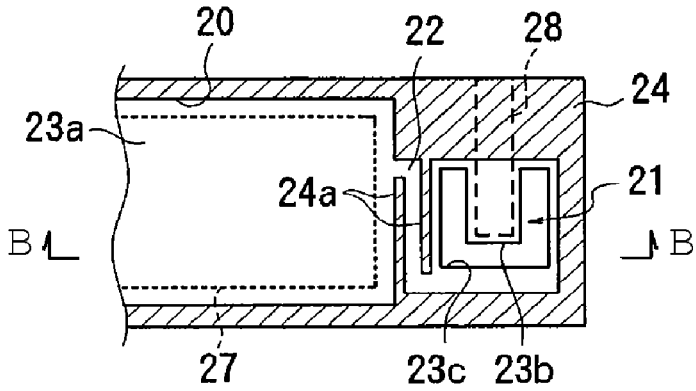
FIGS. 11(*a*) and 11(*b*) illustrate a micropump according to a third embodiment of the present invention, FIG. 11(*a*) being a fragmentary cross section of an upper case, and FIG. 11(*b*) being a cross section taken along line A-A of FIG. 11(*a*).
Figure 11B:
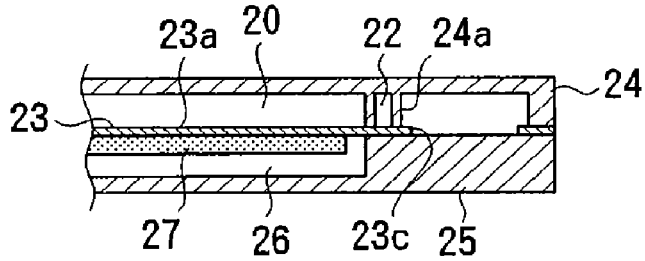

FIGS. 11(*a*) and 11(*b*) illustrate a micropump according to a third embodiment of the present invention. In this embodiment, the length of a communication passage 22 connecting a pump chamber 20 with a check valve 21 is larger than a width thereof. Herein, the communication passage 22 has a crank-like shape. The pump chamber 20 is defined between an elastic-member sheet 23 and an upper case 24. A vibration chamber 26 is defined between the elastic-member sheet 23 and a lower case 25. A piezoelectric actuator 27 is housed in the vibration chamber 26. The piezoelectric actuator 27 is bonded to a back surface of the elastic-member sheet 23. A diaphragm portion 23*a* is provided at the elastic-member sheet 23 at a portion corresponding to the pump chamber 20. A valve portion 23*b* is formed at the elastic-member sheet 23 at a portion corresponding to the check valve 21 by punching or cutting. Reference numeral 23*c* is a punched portion. The valve portion 23*b* closes an intake or discharge flow passage 28. When the volume of the pump chamber 20 is increased or decreased, the valve portion 23*b* opens the flow passage 28.

Figure 12A:
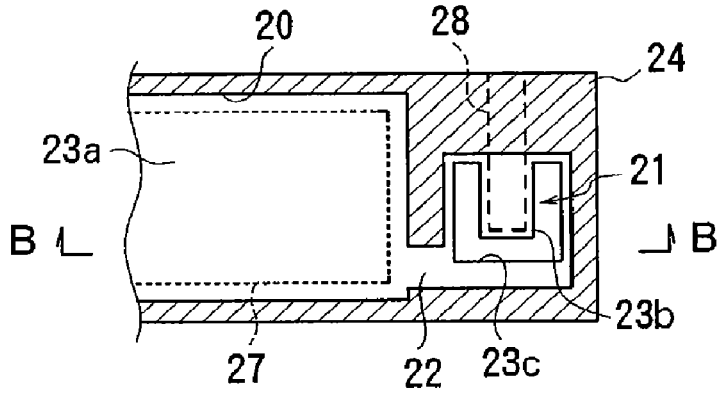
FIGS. 12(*a*) and 12(*b*) illustrate a micropump according to a comparative example of the third embodiment, FIG. 12(*a*) being a fragmentary cross section of an upper case, and FIG. 12(*b*) being a cross section taken along line B-B of FIG. 12(*a*).
Figure 12B:
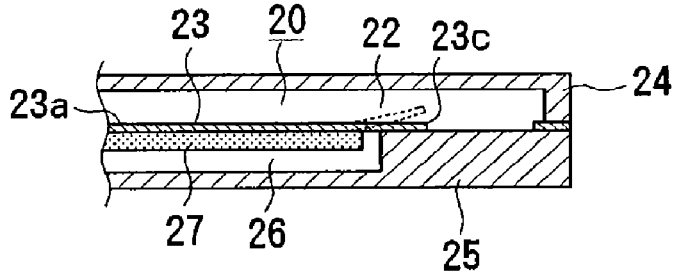

FIGS. 12(*a*) and 12(*b*) illustrate a communication passage 22 having a straight shape, or the communication passage 22 having a length equivalent to or smaller than a width thereof.

In the periphery of the pump chamber 20, the elastic-member sheet 23 is sandwiched between the upper and lower cases 24 and 25, and hence, the elastic-member sheet 23 provides a sealing effect. However, a portion of the elastic-member sheet 23 corresponding to the communication passage 22 which connects the pump chamber 20 with the check valve 21 is not sandwiched by the upper and lower cases 24 and 25. That is, a wall surface is provided only at one side of the elastic-member sheet 23. Thus, liquid has to be prevented from leaking by a bonding force of the elastic-member sheet 23 and the lower case 25. In a case where the communication passage 22 is substantially straight and has substantially equivalent length and width as shown in FIGS. 12(*a*) and 12(*b*), the communication-passage portion of the elastic-member sheet 23 may be separated from the lower case 25 as indicated by a broken line in FIG. 12(*b*), and thus liquid may leak to the vibration chamber 26 from the portion 23*c* of the elastic-member sheet 23 processed by punching or cutting, as a result of a change in pressure of the pump chamber 20 over long-term use.

In contrast, when the communication passage 22 has a crank-like shape as shown in FIGS. 11(*a*), a protruding portion 24*a* is provided to extend from the upper case 24, and thus, the elastic-member sheet 23 can be sandwiched between the protruding portion 24*a* and the lower case 25. Accordingly, the liquid can be reliably prevented from leaking. To provide a structure in which the communication passage 22 has a length larger than a width thereof, the shape of the communication passage 22 does not have to be a crank-like shape, and the communication passage 22 may be a bent passage such as an S-shaped passage or a U-shaped passage.

Fourth Embodiment

Figure 13:
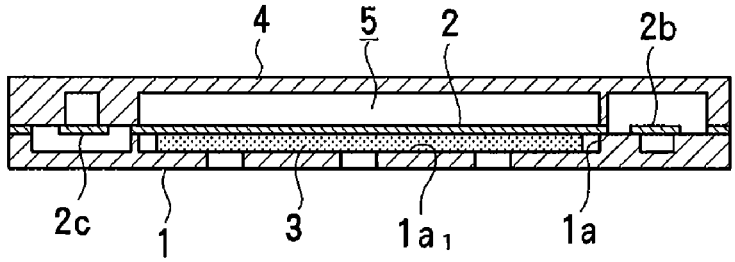
FIG. 13 is a cross section showing a micropump according to a fourth embodiment of the present invention.

In the above-described embodiments, the height of the vibration chamber is sufficiently larger than the thickness of the piezoelectric actuator, and even when the actuator is displaced toward the vibration chamber by a maximum distance, the actuator does not contact the bottom surface of the vibration chamber. However, the back surface of the actuator 3 may come into contact with a bottom surface $\mathbf{1}a_1$ of a vibration chamber 1*a* as shown in FIG. 13. In this case, the back surface of the actuator 3 is supported by the bottom surface $\mathbf{1}a_1$ of the vibration chamber 1*a*. Accordingly, the volume of the pump chamber 5 can be decreased regardless of the direction the actuator 3 is displaced, and also, the thickness of the micropump can be reduced. In this embodiment, like components as in the first embodiment refer like numerals.

Fifth Embodiment

Figure 14:
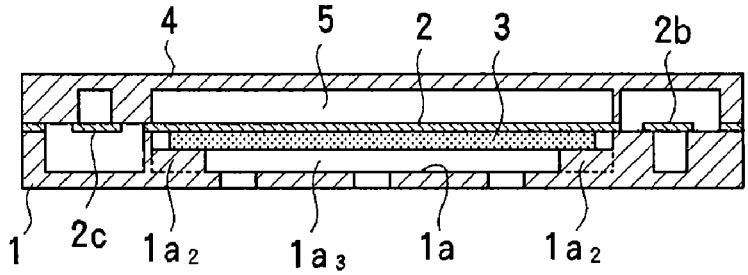
FIG. 14 is a cross section showing a micropump according to a fifth embodiment of the present invention.

Referring to FIG. 14, support portions $\mathbf{1}a_2$ may be provided at the bottom surface $\mathbf{1}a_1$ of the vibration chamber 1*a*, so as to support back surfaces of both end portions of the actuator 3. In addition, a space $\mathbf{1}a_3$ for bending deformation of the actuator 3 may be provided on a back-surface side of a center portion of the actuator 3. Also in this case, the displacement of the actuator 3 can be efficiently transmitted to a diaphragm 2 similarly to FIG. 13. Thus, the thickness of the micropump can be reduced. When the actuator 3 has a rectangular shape, a large volume displacement can be obtained if the actuator 3 undergoes bending displacement in a mode in which both end portions in the longitudinal direction (two short sides) of the actuator 3 serve as supporting points. Hence, when both end portions in the longitudinal direction of the rectangular actuator 3 are supported by the support portions $\mathbf{1}a_2$, the volume displacement of the pump chamber 5 can be further increased as compared with FIG. 13. Herein, like components as in the first embodiment refer like numerals.

In the above-described embodiments, the rectangular piezoelectric actuator is used. However, a square or circular piezoelectric actuator may be employed. It is noted that the rectangular piezoelectric actuator can achieve a larger volume displacement than that of the square or circular piezoelectric actuator. Thus, the rectangular piezoelectric actuator can realize a small and highly efficient micropump.

In the above-described embodiments, while the intake-side check valve and the discharge-side check valve are oppositely provided with the pump chamber interposed therebetween, the intake-side check valve and the discharge-side check valve may be adjacently provided on one side of the pump chamber. Also, while the intake-side check valve and the discharge-side check valve are arranged on both sides in the longitudinal direction of the rectangular pump chamber, the intake-side check valve and the discharge-side check valve may be arranged on both sides in a width direction.

The invention claimed is:

1. A micropump comprising:

an elastic-member sheet having a diaphragm portion, an intake check valve portion, and a discharge check valve portion;

a first case member attached to a first side of the elastic-member sheet, the first case member defining a vibration chamber;

a second case member attached to a second side of the elastic-member sheet, the second case member defining a pump chamber, and the elastic-member sheet providing sealing between the first and second case members, the first and second case members defining an intake-side check valve at the intake check valve portion of the elastic-member sheet and a discharge-side check valve at the discharge check valve portion of the elastic-member sheet; and a piezoelectric actuator attached to the first side of the elastic-member sheet at the diaphragm portion and positioned within the vibration chamber; wherein a bending displacement of the piezoelectric actuator changes a volume of the pump chamber and alternately opens and closes the intake-side check valve and the discharge-side check valve to transport a fluid;

the first case member includes a bottom plate member which is a flat plate, and a first intermediate member in which a vibration-chamber hole, an intake-passage hole isolated from the vibration-chamber hole, and a discharge-space hole isolated from the vibration-chamber hole are provided, the bottom plate member and the first intermediate member being stacked on each other;

the second case member includes a top plate member which is a flat plate, and a second intermediate member in which a pump-chamber hole, an intake-space hole facing the intake-passage hole, and a discharge-passage hole facing the discharge-space hole are provided, the top plate member and the second intermediate member being stacked on each other;

the intake check valve portion of the intake-side check valve is arranged to close the intake-passage hole, and the discharge check valve portion of the discharge-side check valve is arranged to close the discharge-passage hole; and each of the intake check valve portion and the discharge check valve portion includes a tongue shaped portion that is attached to the elastic-member sheet in a cantilever manner along one edge portion of the tongue shaped portion.

2. The micropump according to claim 1, wherein the intake-side check valve and the discharge-side check valve are provided at opposite positions with the pump chamber interposed therebetween, and the fluid entering from the intake-side check valve is transported to the discharge-side check valve via the pump chamber.

3. The micropump according to claim 1, wherein the piezoelectric actuator has a rectangular shape, and the intake-side check valve and the discharge-side check valve are respectively arranged at positions near short sides of the piezoelectric actuator.

4. The micropump according to claim 3, wherein the intake-side check valve and the discharge-side check valve are respectively arranged along short sides of the rectangular piezoelectric actuator.

5. The micropump according to claim 1, wherein the intake-passage hole is connected to the pump chamber with a first communication passage, and the discharge-passage hole is connected to the pump chamber by a second communication passage, wherein a length of the first communication passage and a length of the second communication passage are respectively larger than widths thereof.

6. The micropump according to claim 5, wherein each of the first communication passage and the second communication passage is substantially S-shaped.

* * * * *